US009400454B1

(12) United States Patent
Falk Yogev et al.

(10) Patent No.: US 9,400,454 B1
(45) Date of Patent: Jul. 26, 2016

(54) IMAGING SYSTEM OIL MANAGEMENT

(71) Applicant: HEWLETT-PACKARD INDIGO B.V., Amstelveen (NL)

(72) Inventors: Noa Falk Yogev, Petach Tikwa (IL); Oren Wilde, Rishon Le Zion (IL); Barak Rosenstein, Nes Ziona (IL); Mark Sandler, Rehovot (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 0 days.

(21) Appl. No.: 14/814,691

(22) Filed: Jul. 31, 2015

(51) Int. Cl.
*G03G 15/10* (2006.01)

(52) U.S. Cl.
CPC ..... *G03G 15/107* (2013.01); *G03G 15/10* (2013.01)

(58) Field of Classification Search
CPC ..... G03G 15/10; G03G 21/10; G03G 15/107
USPC ..... 399/237, 250, 359
See application file for complete search history.

(56) References Cited

U.S. PATENT DOCUMENTS 8,322,831 B2 12/2012 Bachar et al.
2004/0033086 A1* 2/2004 Vejtasa ..... G03G 21/10 399/237
2006/0037887 A1 2/2006 Nickel
2009/0175665 A1* 7/2009 Wilde
2012/0014709 A1 1/2012 Pohlt
2012/0079955 A1 4/2012 Lam et al.
2013/0126438 A1 5/2013 Martini et al.
2013/0308984 A1* 11/2013 Sandler ..... 399/237

OTHER PUBLICATIONS

"Eco-friendiv Printing—Sustainability in Action", Precision disc, Dec. 14, 2009, 2 pgs, http://www.predisc.com/printing/eco-friendly-printing htm.

* cited by examiner

*Primary Examiner* — Walter L Lindsay, Jr.
*Assistant Examiner* — Milton Gonzalez
(74) *Attorney, Agent, or Firm* — HP Inc Patent Department

(57) ABSTRACT

An oil routing system has a first fluid transport device to transport clean oil from an oil recycling apparatus of an imaging system to a first storage tank, the oil having been recycled after use in the imaging system by the recycling apparatus, a second fluid transport device to transport clean oil to a second storage tank, and a third fluid transport device. The clean oil is to be stored in the first storage tank and second storage tank as clean oil, and the third fluid transport device to return clean oil from the first storage tank to the imaging system for reuse, wherein of the first and second storage tanks, the oil routing system routes clean oil to the imaging system for reuse only from the first storage tank.

11 Claims, 4 Drawing Sheets

IMAGING SYSTEM OIL MANAGEMENT

BACKGROUND

Oil may be used as a carrier fluid for inks used in printing, for example imaging oil may be used as a carrier fluid for charged ink. The oil can also be used as a cleaning fluid for some maintenance activities.

BRIEF DESCRIPTION OF THE DRAWINGS

Examples of the present disclosure are further described hereinafter with reference to the accompanying drawings, in which.

DETAILED DESCRIPTION

Oil, for use in imaging systems, herein referred to as imaging oil, may be provided in ink cartridges or ink tubes, but may also be sold separately. Replacing imaging oil can be expensive. Some imaging systems, such as printers and/or presses, can have significant oil waste streams. Oil can be recycled, and some imaging systems may have an imaging oil recycling system, but if imaging oil enters the waste stream and is mixed with other waste products from the imaging system (such as in an oily waste bottle and/or in a waste tank), then the imaging oil may no longer be of sufficient quality to be reused by the imaging system for at least some purposes. Allowing more imaging oil to be recycled can increase the resource efficiency of an imaging system, and also may reduce costs. Recycled oil may be returned for use in components of the imaging system, such as an imaging mechanism for producing an image on a substrate.

An imaging system may have a storage tank to store recycled imaging oil and to resupply the imaging system as needed. The imaging system may generate more recycled oil than is required to resupply a single imaging system, and the tank may overflow into a mixed waste tank. Imaging oil in the mixed waste tank may not be used to resupply the imaging system, as the quality of the imaging oil will no longer be sufficiently high.

Figure 1:
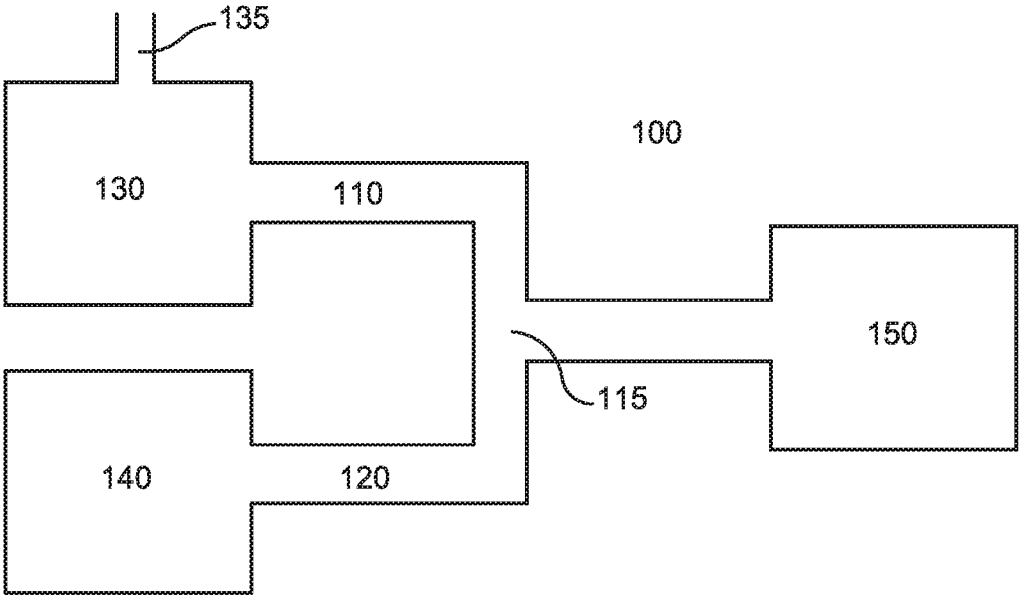
FIG. 1 schematically illustrates an imaging oil routing system according to some examples.

FIG. 1 schematically illustrates an example of an imaging oil routing system 100. Clean imaging oil is received from an imaging oil recycling apparatus 150, and a first fluid transport device 110 may be arranged to transport the clean imaging oil from the imaging oil recycling apparatus 150 to a first storage tank 130. A second fluid transport device 120 may be arranged to transport clean imaging oil from the imaging oil recycling apparatus 150 to a second storage tank 140. The imaging oil recycling apparatus 150 may be arranged to receive oil from an imaging system. A third fluid transport device 135 may return clean oil from the first storage tank 130 to the imaging system for reuse. Of the first and second storage tanks, the imaging oil routing system may be arranged to route clean imaging oil to the imaging system for reuse only from the first storage tank. That is, the imaging oil recycling apparatus 150 of some examples does not route oil from the second storage tank to the imaging system.

The clean imaging oil is stored in the first storage tank 130 as clean imaging oil, and in the second storage tank 140 as clean imaging oil. Clean imaging oil is oil that is suitable for reuse by the imaging system. In some cases, clean imaging oil is recycled imaging oil that has not been mixed with other waste products from the imaging system. FIG. 1 is just one illustration of the image routing system 100, it is not intended to limit the possible layout and architecture of the system and other layouts are possible.

Some examples allow at least some excess imaging oil, not required by a first imaging system (e.g. required for normal printing, maintenance and cleaning activities), to be reused, instead of being wasted. For example, such waste may occur when imaging oil is contaminated by being combined with other oils or waste from the imaging system. In some examples, multiple imaging systems may be supplied with imaging oil (e.g. for maintenance requirements) using a single imaging system's recycling apparatus.

The first storage tank 130 may be used to resupply the imaging system in which it resides (or with which it is associated), with imaging oil. For example, the first storage tank 130 may have an outlet for connecting to an oil inlet of the imaging system. In some examples, the second storage tank 140 does not have an outlet, or does not have an outlet for connecting to the imaging system. In some examples, the second storage tank 140 is removable. This may allow a user to remove the second storage tank 140 and use it to supply recycled imaging oil to another imaging system, for example, by removing the second storage tank 140 and pouring the contents of the second storage tank 140 into an imaging oil inlet of a second imaging system, or by connecting the second storage tank 140 to the inlet of a second imaging system. Alternatively, the user may remove the second storage tank 140 and store the imaging oil, for future use, in the second storage tank 140 (e.g. on a shelf). An empty storage tank may then be connected to the second fluid transport device 120, in place of the second storage tank 140. In some examples, the second storage tank 140 is the same as a container that imaging oil is supplied in (e.g. same shape and size), and therefore would not require any modification of the user's behavior. For example, recycled imaging oil and new imaging oil could be stored in the same place, and in the same manner (e.g. same shelf space). It may also be possible to use the second storage tank 140 with the same funnel connection for pouring imaging oil into the imaging oil inlet of an imaging system.

Some maintenance activities, such as filter replacements, may require additional imaging oil be provided to the imaging system (e.g. from the second storage tank 140 of the same or another imaging system). Where the imaging system has a first storage tank 130 for storing recycled imaging oil, the need to resupply the imaging system may depend on the size of the first storage tank 130 and the amount of oil remaining inside the first tank 130.

In some examples, the imaging oil routing system 100 may route imaging oil to the first storage tank 130, or alternatively to the second storage tank 140, based on an amount of imaging oil in the first storage tank 130.

In some examples, the imaging oil routing system 100 may route imaging oil to the first storage tank 130 when the amount of imaging oil stored in the first storage tank 130 is less than a predetermined threshold amount, and, if the amount of imaging oil stored in the first storage tank 130 is equal to or higher than the predetermined threshold amount, route imaging oil to the second storage tank 140. In some examples the predetermined threshold amount may be set based on the amount of imaging oil that an imaging system needs for regular printing activities, in some examples the predetermined threshold amount may be set based on the amount of imaging oil that a imaging system needs for its own maintenance needs. This allows up to a predetermined amount of imaging oil to be retained for use in the first imaging system, which prevents, or reduces the need for the first imaging system to be refilled with imaging oil. In some examples the predetermined threshold amount may be set based on the predicted usage of the imaging system, for example by taking into consideration the average print coverage and AMPV (average monthly print volume) of the imaging system, and may be based on historical usage data.

In some examples the first fluid transport device 110, and second fluid transport device 120 are connected to the imaging oil recycling apparatus by a three-way connector 115. In some examples the three-way connector is a convenient, simple structure to allow the first fluid transport device 110 and second fluid transport device 120 to be in fluid communication with the recycling apparatus 150.

Figure 2:
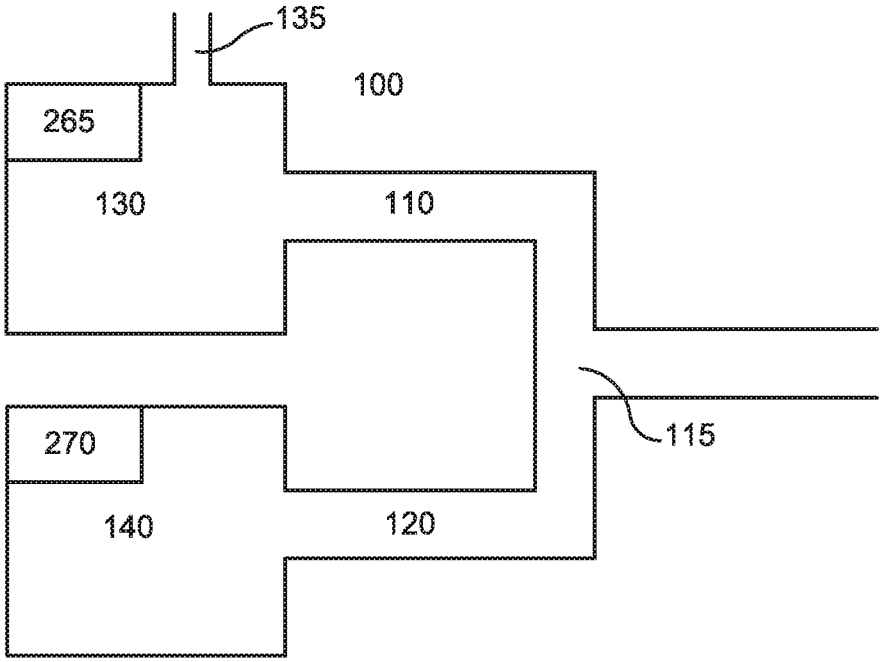
FIG. 2 schematically illustrates an imaging oil routing system according to some examples.

FIG. 2 illustrates schematically an arrangement according to some examples. The first storage tank 130 may include a sensor 265. In some examples the sensor indicates whether the first storage tank 130 is full. In some examples the sensor indicates the amount of imaging oil stored in the first storage tank 130. In some examples the second imaging oil storage tank 140 includes a sensor 270. In some examples the sensor 270 indicates whether the second storage tank 140 is full. In some examples the sensor 270 indicates the amount of imaging oil stored in the second storage tank 140. The number of sensors in each tank is not limited to one; the first storage tank 130 and/or second storage tank 140 may have two or more sensors. A sensor may indicate that the corresponding tank is full if it determines that imaging oil stored in the tank exceeds a predetermined amount or is above a predetermined level. In some examples the sensor or sensors need not be physically inside the storage tanks. For example, an optical sensor may be positioned outside of the tank that it monitors or with which it is associated.

In some examples the flow of oil to the first storage tank 130 and flow to the second storage tank 140 may be controlled using an overflow arrangement. This may provide a simple, passive arrangement to control the flow of clean imaging oil. In some examples, the height of the top of the overflow mechanism may be adjusted for greater flexibility in controlling the flow of the clean imaging oil. The overflow mechanism may be included in the second fluid transport device 120.

Figure 3:
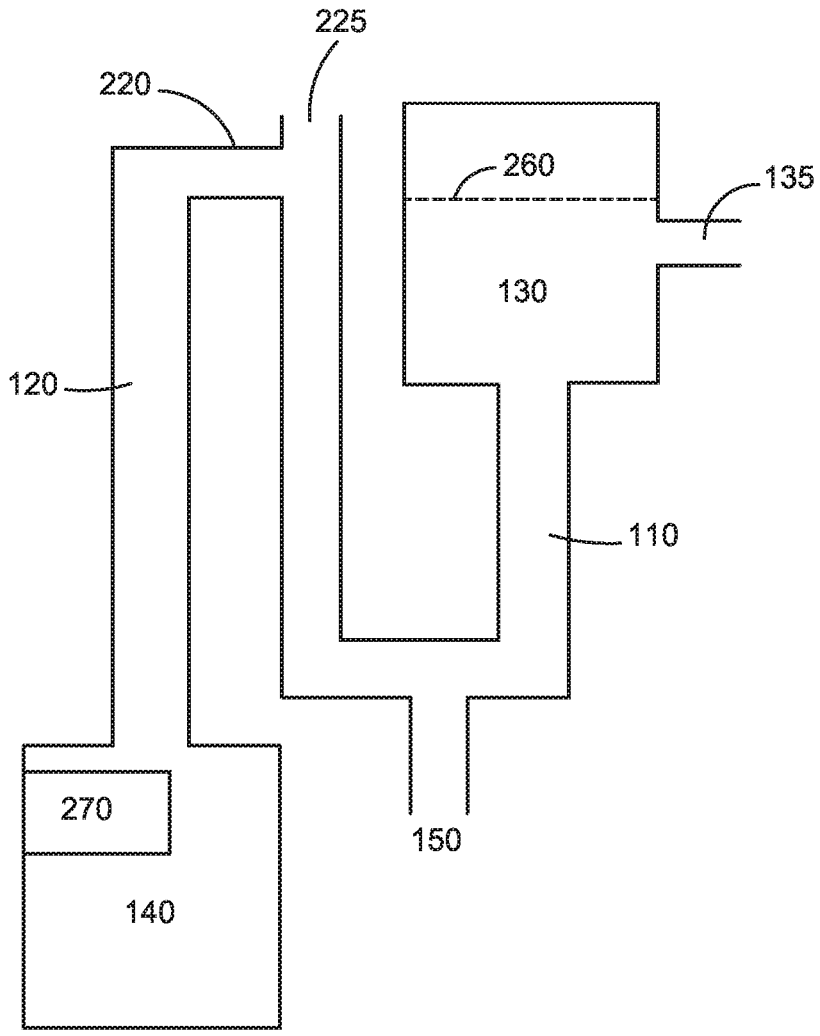
FIG. 3 schematically illustrates an imaging oil routing system using an overflow mechanism according to some examples.

FIG. 3 illustrates a possible implementation of the overflow mechanism of some examples. The first storage tank 130 may have a high level 260. The high level 260 may be selected to correspond to the volume of imaging oil that is required for use by the imaging system. The high level 260 may correspond to a selected level chosen by an engineer, manufacturer or a user. The high level is chosen as the minimum amount of oil in the first tank before oil flows to the second tank. A fluid channel of the second fluid transport device 120 may have a maximum height 220 that is above the high level 260, forming the overflow arrangement, such that oil will overflow to the second tank 140 when the oil level in the overflow mechanism exceeds the maximum height 220. As the first storage tank 130 fills, oil will fill the portion of the second fluid transport device 120 between the first tank and the maximum height 220 of the overflow mechanism. When the oil level in the first storage tank 130 and the overflow mechanism reach the maximum height 220, the oil will overflow into the portion of the second fluid transport device 120 between the overflow mechanism and the second storage tank 140, and then to the second storage tank 140. This may prevent imaging oil flowing to the second storage tank when the level of imaging oil in the first storage tank 130 is below the high level 260. According to some examples, this ensures that oil is routed to the second storage tank 140 only when the first storage tank 130 has at least a predetermined amount of oil (e.g. sufficient oil to maintain normal printing)

In some examples there may be an air discharge opening 225 at the top of the second fluid channel 120. The air discharge opening may allow air to escape from the second fluid channel 120, and may prevent the flow being disturbed. A top of the air discharge opening 225 may be higher than a waste overflow outlet of the first storage tank 130, such that excess oil flows to the waste overflow rather than the out of the air discharge opening.

In some examples there is a sensor 265 at the high level 260 to indicate that the amount of imaging oil stored in the first storage tank 130 has reached the high level 260. FIG. 2 is not drawn to scale, the heights and relative positions of the features of FIG. 2 may differ in other examples. The second storage tank 140 may be below the maximum height 220 of the overflow mechanism and/or below the high level 260 of the first storage tank 130, such that the flow of oil into the second storage tank 140 may be due to gravity. The second storage tank 140 may be below the level of the first storage tank 130.

In some examples the first storage tank may include a waste overflow, the waste overflow may lead to a mixed waste bottle, for example. The maximum height 220 of the overflow mechanism may be above the high level 260 of the first storage tank 130 (selected as a minimum level of oil to be in the first storage tank 130 in order to excess oil to be provided to the second storage tank 140). The maximum height 220 of the overflow mechanism may be below a waste overflow outlet of the first storage tank 130. This allows the first storage tank 130 to fill up to the high level 260, and ensures the second storage tank 140 receives imaging oil rather than the waste overflow of the first storage tank 130. Where a sensor is provided to determine whether or not an oil level in the first storage tank is at or above the high level 260, the level of the overflow mechanism may be above the level of the sensor.

In some examples there may be an alternative route to a waste storage tank or waste overflow to which imaging oil may be routed if both the first storage tank 130 and second storage tank 140 are full.

In some examples the flow of the imaging oil to the first storage tank 130 and flow to the second storage tank 140 may be controlled without using an overflow mechanism. In some examples the flow to the first storage tank 130 and/or the second storage tank 140 may be based on a response of sensor 265, or sensor 270, or both sensor 265 and sensor 270. In some examples, the flow to first storage tank 130 and flow to the second storage tank 140 may be controlled by a passive, or by an active mechanism. In some examples the active mechanism may use a valve, or a plurality of valves. The valves may be controlled based on an interaction with sensor 265, or sensor 270, or both sensor 265 and sensor 270. In some examples the active mechanism may be controlled by a control unit. The control unit may be integrated with the imaging oil routing system, imaging oil recycling apparatus, and/or with the imaging system. Alternatively, the control unit may be separate from the imaging oil routing system, imaging oil recycling apparatus and/or the imaging system.

In some examples a pump, such as a mix pump, is used to pump imaging oil between the imaging oil recycling apparatus, first fluid transport device 110, and second fluid transport device 120. In some examples the pump pumps imaging oil to the first imaging oil tank 130 and second imaging oil tank 140 only whilst the first imaging oil tank 130 and/or the second imaging oil tank 140 are not full. In some examples the pump does not operate when both of the first and second storage tanks are full. This may prevent the tanks from being overfilled. An indication may be sent to the user to notify the user that the first storage tank 130, or second storage tank 140, or both are full. This may enable the user to remove the full tank, for example and use the oil in the second storage tank 140 in another imaging system, or store the oil for later use. In some examples the pump may be set to run at all times while either of the first or second storage tanks are not full. The determination of whether or not a storage tank is full may be based on a determination of whether or not the amount or level of imaging oil in the tank is at or above a predetermined level and may be based on a sensor output. The pump may be included in the recycling system. The pump may be arranged to add one or more additives to oil condensed by the recycler at a predetermined ratio in order to produce the recycled imaging oil.

Figure 4:
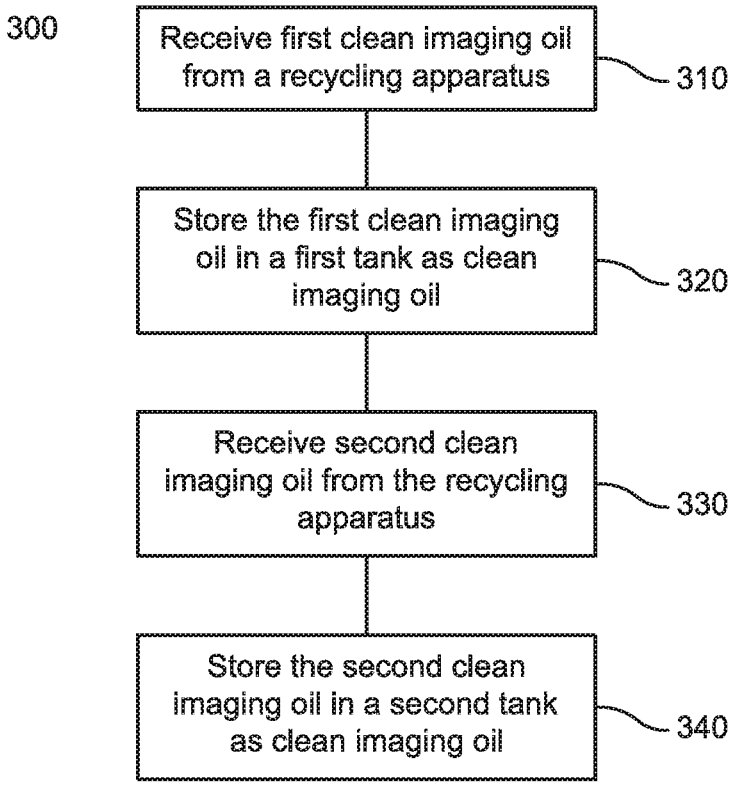
FIG. 4 schematically illustrates a method of routing imaging oil according to some examples.

FIG. 4 is a flow chart schematically illustrating an example of a method 300. A first storage tank may receive first clean imaging oil from a recycling apparatus 310. The clean imaging oil may be stored in the first tank as clean imaging oil 320. A second tank may receive second clean imaging oil from the recycling apparatus 330. The second clean imaging oil may be stored in the second tank as clean imaging oil.

In some examples the method may comprise, removing the second tank, and may further comprise using the contents of the second tank to supply a second imaging system with imaging oil. In some examples the method may comprise storing the second storage tank in a storage area, for future use.

Figure 5:
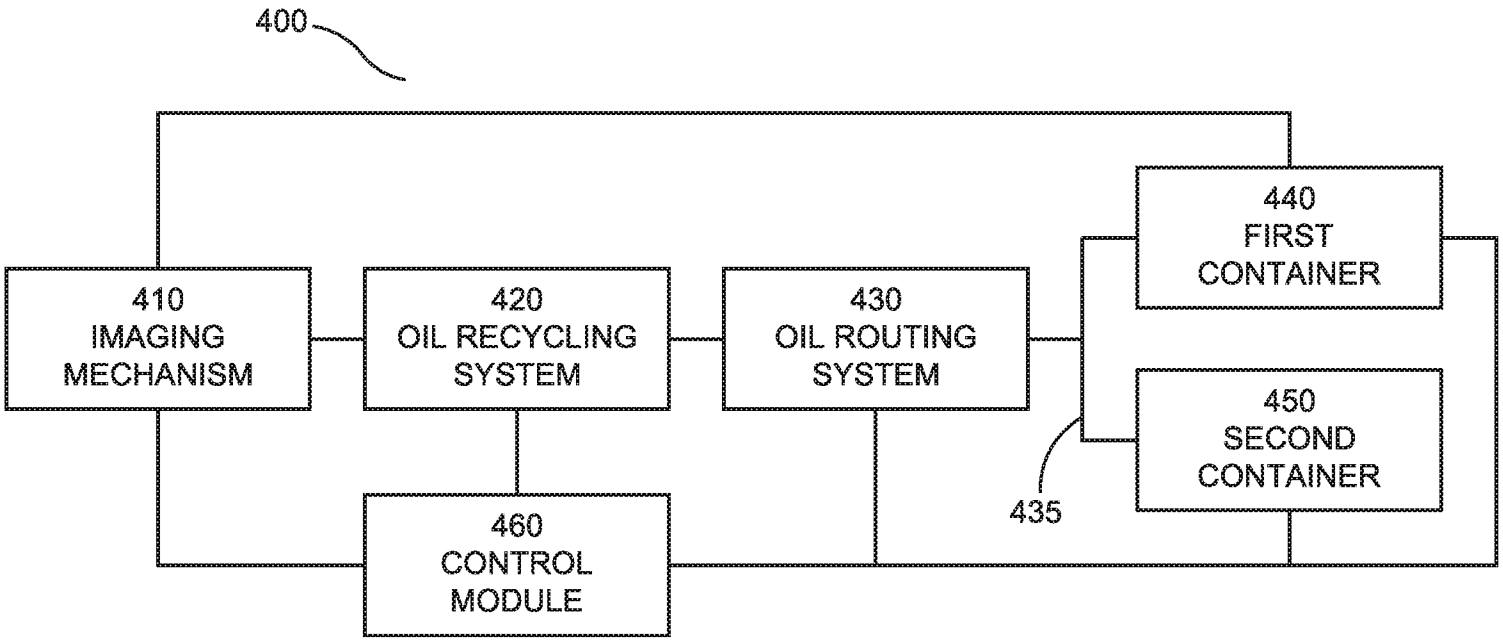
FIG. 5 schematically illustrates a printing system, including an imaging oil routing system according to some examples.

FIG. 5 schematically illustrates a print system 400. The imaging system 400 may include an imaging mechanism 410 and an imaging oil recycling system 420. The imaging mechanism 410 may be arranged to produce an image on a substrate, and may include ink tanks, for example. The imaging oil recycling system 420 may be arranged to recycle dirty oil that has been used by the imaging mechanism 410, the imaging oil recycling system 420 may collect condensed imaging oil that has been evaporated, and separate the collected oil from water. The imaging oil recycling system may add additives to the recycled imaging oil. The imaging oil recycling system 420 is further arranged to provide clean imaging oil to an imaging oil routing system 430. The imaging oil routing system 430 may include an arrangement as described above. The imaging oil routing system 430 is arranged to route clean imaging oil to a first container 440 and to a second container 450. The routing may be based on an amount of clean imaging oil stored in the first container 440. The first container 440 is arranged to recirculate clean imaging oil into the imaging mechanism 410 (e.g. into ink tanks of the imaging mechanism 410). A storage line 435 is configured to provide clean imaging oil to the second container 450 from the imaging oil routing system 430, wherein the clean imaging oil is stored in each of the first container and second container separate from waste (e.g. waste fluid) from the imaging system. A control module 460 may control the flow of the recycled imaging oil between the first container 440 and second container 450.

Some examples herein refer to the first and second storage tanks. Any suitable container may be used as the first or second storage tank. For example a container may be a bottle, a vessel, or a bag, or any other device suitable for storing fluid. The first storage tank 130 and/or second storage tank 140 may include any arrangement suitable for holding clean imaging oil.

In some examples the first storage tank may be a recycled imaging oil buffer, to store recycled imaging oil.

In some examples the first fluid transport device 110 and/or second fluid transport device 120 may be a fluid line, a pipe, a tube, or a hose. The first fluid transport device 110 and/or second fluid transport device 120 may be flexible, rigid, or semi-rigid.

In some examples the imaging system may be a press imaging system. In some examples the imaging oil may be a mineral oil or a non-conductive hydrocarbon fluid.

In some examples the sensor may detect a volume or level of oil in the first storage tank 130 and/or second storage tank 140, in some examples the sensor may detect if the first storage tank 130 and/or second storage tank 140 are full. The sensor may be a float sensor or an optical sensor, for example. In some examples the sensor detects a resistance or conductivity of oil in a tank to determine an amount of oil in the tank. In some examples the sensor may give information regarding the imaging oil, for example the sensor may detect the quality of the oil, the cleanliness, or presence of any contaminants. Some or all of these sensors may be provided in the recycling apparatus.

Some examples of the imaging oil routing system may be suitable for retrofitting, such that an existing imaging system may be modified to include an imaging oil routing system as described above.

In some examples the first tank 130 may comprise two or more linked volumes, e.g. containers linked by tubes and functioning essentially as a single tank.

In some arrangements oil from the recycling apparatus may enter the second storage tank 140 via the first storage tank 130. For example, oil from the recycling apparatus 150 may be provided to the first storage tank 130 via the first fluid transport device 110. The second fluid transport device 120 may allow oil to flow (depending on an oil level in the first storage tank 130) from the first storage tank 130 to the second storage tank 140.

In some examples the imaging system may be a printer, or a printing system. In some examples the imaging system may be a press or press system. In some examples the imaging system may be a liquid electrophotography (LEP) system.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, or groups described in conjunction with a particular aspect or example are to be understood to be applicable to any other aspect or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. Implementations are not restricted to the details of any foregoing examples.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An oil routing system comprising:

a first fluid transport device to transport clean oil from an oil recycling apparatus of an imaging system to a first storage tank, the oil having been recycled after use in the imaging system by the recycling apparatus;

a second fluid transport device to transport clean oil to a second storage tank; and a third fluid transport device, wherein the clean oil is to be stored in the first storage tank and second storage tank as clean oil, the third fluid transport device to return clean oil from the first storage tank to the imaging system for reuse, of the first and second storage tanks, the oil routing system routes clean oil to the imaging system for reuse only from the first storage tank, and the clean oil is distributed to the first storage tank and second storage tank based on an amount of clean oil stored in the first storage tank.

2. The oil routing system of claim 1, wherein the second storage tank is removable.

3. The oil routing system of claim 1, wherein the clean oil is transported to the first storage tank when the amount of clean oil in the first storage tank is below a threshold amount, and the clean oil is transported to the second storage tank when the amount of clean oil in the first storage tank is equal or above the threshold amount.

4. The oil routing system of claim 1, wherein the first fluid transport device and second fluid transport device are connected by a three-way connector, and the three-way connector is also connected to the oil recycling apparatus.

5. The oil routing system of claim 1, wherein the second fluid transport device includes an air discharge opening.

6. A liquid electrophotography printing (LEP) system, comprising an oil storage system, to store oil that has been processed into clean oil by an oil recycling apparatus, the oil storage system comprising:

a first container to store clean oil from the oil recycling apparatus, the first container to recirculate clean oil into the LEP system; and a second container to store clean oil from the oil recycling apparatus that has not been in the first container, wherein of the first and second containers, the oil routing system routes clean oil to the imaging system only from the first container, and the clean oil is to be stored in the first container and second container separate from waste fluid from the LEP system.

7. The LEP system of claim 6, wherein clean oil is transported to the first container when the amount of clean oil in the first container is below a threshold amount, and to the second container when the amount of clean oil in the first container is equal to, or more than the threshold amount.

8. The LEP system of claim 6, further comprising a sensor to detect a level of clean oil or an amount of clean oil in the second container.

9. A method of managing oil, the method comprising:

receiving first clean oil from a recycling apparatus of an imaging system, storing the first clean oil in a first tank as clean oil, receiving second clean oil different from the first clean oil from the recycling apparatus;

storing the second clean oil in a second tank as clean oil; and of the first and second tank, routing clean oil only from the first tank to the imaging system.

10. The method of claim 9, wherein the oil is stored in the first tank or second tank based on an amount of clean oil in the first tank.

11. The method of claim 9, removing the second tank, and using the removed second tank to supply clean oil to a second imaging system.

* * * * *